US009277781B2

(12) United States Patent
Hardy

(10) Patent No.: US 9,277,781 B2
(45) Date of Patent: Mar. 8, 2016

(54) SPORTS FACE GUARD

(76) Inventor: Jonathan James Ean Hardy, Hampshire (GB)

( * ) Notice: Subject to any disclaimer, the term of this patent is extended or adjusted under 35 U.S.C. 154(b) by 12 days.

(21) Appl. No.: 13/983,541

(22) PCT Filed: Feb. 2, 2012

(86) PCT No.: PCT/EP2012/051799

§ 371 (c)(1),
(2), (4) Date: Aug. 2, 2013

(87) PCT Pub. No.: WO2012/104390

PCT Pub. Date: Aug. 9, 2012

(65) Prior Publication Data

US 2013/0312165 A1 Nov. 28, 2013

(30) Foreign Application Priority Data

Feb. 4, 2011 (GB) ..... 1101979.1

(51) Int. Cl.
*A42B 3/20* (2006.01)
*A42B 3/18* (2006.01)
*A42B 3/22* (2006.01)

(52) U.S. Cl.
CPC ... *A42B 3/20* (2013.01); *A42B 3/18* (2013.01); *A42B 3/222* (2013.01); *A42B 3/227* (2013.01)

(58) Field of Classification Search
CPC ..... A42B 3/222; A42B 3/18; A42B 3/20
USPC ..... 2/424, 425
See application file for complete search history.

(56) References Cited

U.S. PATENT DOCUMENTS

| | | | | |
|---|---|---|---|---|
| 1,775,009 | A * | 9/1930 | Weber | 2/9 |
| 2,502,377 | A | 3/1950 | Goldsmith et al. | |
| 2,627,602 | A | 2/1953 | Goldsmith | |
| 4,631,758 | A | 12/1986 | Abraham et al. | |
| 5,384,914 | A | 1/1995 | Caveness et al. | |
| 5,661,849 | A * | 9/1997 | Hicks | 2/9 |
| 5,799,337 | A * | 9/1998 | Brown | 2/421 |
| 5,806,088 | A | 9/1998 | Rector et al. | |
| 6,047,400 | A | 4/2000 | Spencer | |
| 6,189,156 | B1 | 2/2001 | Loiars | |
| 6,301,719 | B1 | 10/2001 | Goodhand et al. | |

(Continued)

FOREIGN PATENT DOCUMENTS

| | | | |
|---|---|---|---|
| AU | 2002100570 | A8 | 11/2002 |
| AU | 2003204672 | A1 | 1/2004 |

(Continued)

*Primary Examiner* — Shaun R Hurley
*Assistant Examiner* — Bao-Thieu L Nguyen
(74) *Attorney, Agent, or Firm* — Knobbe Martens Olson & Bear LLP

(57) ABSTRACT

A face guard has a construction of interconnected struts, and creates an unobstructed viewing aperture proximate to the eyes of a wearer during use. The face guard includes a forward transverse sill defining at least one boundary of the viewing aperture. The forward transverse sill includes at least two generally transverse struts extending across the front of the face of a wearer during use. Surfaces at the proximal and distal edges of the transverse sill are spaced linearly apart and lie approximately along a common viewing axis of a wearer during use. The sill presents a reduced profile in the field of view of a wearer while presenting an increased surface for contact with an incoming projectile such as a ball, allowing the ball to be impeded and deflected.

10 Claims, 3 Drawing Sheets

(56) References Cited

U.S. PATENT DOCUMENTS

| | | | | |
|---|---|---|---|---|
| 6,421,829 | B2 * | 7/2002 | Halstead et al. | 2/9 |
| 6,763,524 | B2 * | 7/2004 | Halstead et al. | 2/9 |
| D593,729 | S * | 6/2009 | McLaughlin | D2/868 |
| 8,209,784 | B2 * | 7/2012 | Nimmons et al. | 2/424 |
| 8,499,366 | B2 * | 8/2013 | Nimmons et al. | 2/425 |
| 2001/0023526 | A1 | 9/2001 | Halstead et al. | |
| 2004/0040073 | A1 * | 3/2004 | Morrow et al. | 2/424 |
| 2005/0235403 | A1 * | 10/2005 | Ide et al. | 2/425 |
| 2007/0151003 | A1 * | 7/2007 | Shih | 2/424 |
| 2007/0214537 | A1 | 9/2007 | Durocher et al. | |
| 2007/0250990 | A1 * | 11/2007 | Brown et al. | 2/414 |
| 2007/0250992 | A1 * | 11/2007 | Brown | 2/424 |
| 2008/0000001 | A1 | 1/2008 | Benvenuto | |
| 2008/0016600 | A1 | 1/2008 | Hahn et al. | |
| 2009/0044316 | A1 | 2/2009 | Udelhofen | |
| 2009/0083891 | A1 | 4/2009 | Cote | |
| 2009/0083900 | A1 | 4/2009 | Wallace | |
| 2009/0106883 | A1 * | 4/2009 | Wade | 2/424 |
| 2012/0017358 | A1 * | 1/2012 | Princip et al. | 2/414 |
| 2012/0216339 | A1 * | 8/2012 | Nimmons et al. | 2/414 |

FOREIGN PATENT DOCUMENTS

| | | | |
|---|---|---|---|
| CA | 2618061 | A1 | 7/2009 |
| EP | 1941807 | A1 | 9/2008 |
| WO | 03056958 | A1 | 7/2003 |
| WO | 2009018442 | A1 | 2/2009 |
| WO | 2009090410 | A1 | 7/2009 |

* cited by examiner

SPORTS FACE GUARD

CROSS-REFERENCE TO RELATED APPLICATIONS

This application is the U.S. National Phase under 35. U.S.C. §371 of International Application PCT/EP2012/051799, filed Feb. 2, 2012, which claims priority to U.K Patent Application No. 1101979.1, filed Feb. 4, 2011. The disclosures of the above-described applications are hereby incorporated by reference in their entirety.

The present invention relates to the field of protective sports equipment for providing facial protection especially in connection with ball sports. Most particularly, the present invention relates to a cage type face guard for use in connection with a helmet.

BACKGROUND

Face guards of various types are known. Many designs of face-guards have been suggested for use in connection with ball sports or sports in which a projectile such as a puck is in play. A basic wire mesh type face guard, connectable to a helmet, is known from US 2009/0083891. The relatively fine gauge mesh of the guard may make it unsuitable for players of sports requiring a less obstructed line of sight between the players and a moving projectile in play. Another example of a face guard can be seen from WO 2009/018442, which shows a hybrid type helmet face mask, wherein the mask incorporates both a visor and a cage and wherein the visor serves to add protection across the field of vision of a wearer, across which the protective cage of the guard is fully open. For many ball sports, the use of visors is not preferred because they tend to increase discomfort as a result of enclosing the user more completely. Moreover, visibility through visors becomes impaired as the visor becomes scratched or soiled. EP 1941807 discloses a guard for a sports helmet in which the cage type guard has a relatively unobstructed viewing aperture, albeit narrow enough not to require an additional visor. In WO 03/056958, a stand-alone cage type cage type face guard which has an unobstructed transverse viewing aperture for both eyes. In U.S. Pat. No. 6,189,156, a helmet has a cage type guard with an open but narrow viewing aperture which is complemented by a visor across the viewing aperture. From the above, it can readily be inferred that many attempts have been made to develop comfortable face protection for sportspeople which provides both good protection while allowing good visibility. As yet, there is no face-guard which provides optimum advantages in both respects. A wider viewing gap tends to improve visibility, while nevertheless increasing the risk that a projectile will force its way through the viewing aperture, even if its dimensions are greater than the viewing aperture dimensions. In such cases, significant injury may result, especially because the viewing aperture is in front of the wearer's eyes.

Additional cage type face guards with viewing apertures are known which co-operate with peaked headgear or helmets. Examples can be seen from WO 2009/090410, AU 20022100570 and AU 2002204672, all of which relate to cricket helmets. The face-guards illustrated in each of these documents, can be described as a jaw type guard because it surrounds the jaw and also the ears of a wearer. The topmost transverse forward struts of jaw-type guards extends below the eye level of a wearer during use. Protection above the level of the eye is provided by virtue of the rigid helmet peak. In US 2009/0044316, US 2007/0250992 there have been attempts to combine a full face guard with a peaked helmet, wherein additional eye level protection is provided by a transverse forward strut above the level of the eye during use. Evidently, the presence of the additional upper transverse strut reduces visibility through the viewing aperture. In US 2007/0250990, an attempt has been made to provide reinforcement to the helmet peak to increase protection above the eye level in connection with a jaw type guard. Because of the increased protection available to players who wear helmets with face guards, the number of serious facial injuries has been reduced. Nevertheless, it is thought that some players feel a sense of invulnerability while wearing head and facial protection and are thereby inclined to attempt to play dangerous balls which they ordinarily would have avoided. In addition, it is thought that some players may be inclined to adjust the width of a viewing gap through their protective headgear to improve their view, even while marginally increasing the risk that a projectile such as a ball might force its way through causing injury.

The present invention seeks to provide an improved face-guard having regard in particular to enhanced protection and minimal visual obstruction.

SUMMARY OF THE INVENTION

The invention provides a sports face guard having a cage type construction with a generally open viewing aperture, bounded by one transverse sill which has linearly spaced respective first and second surfaces adjacent a respective distal and proximal edge of the sill. The said first and second surfaces both face into the viewing aperture and lie approximately along a common viewing axis of a wearer during use. The transverse sill is comprised of at least two substantially adjacent, generally transverse struts extending across the front of the face of a wearer during use and separated by a gap.

The present invention may be realised in a variety of ways, including for example as a jaw type face guard or as a full face guard. According to the invention, there is provided an improved face guard presenting enhanced friction surfaces which act to dissipate energy upon impact with a projectile and which, when attached to a helmet, improves the blocking or jamming effect of the guard on the projectile over previously known face guards, without impairing visibility through the guard. To that end, the face guard of the invention, while extending around at least the jaw of a wearer, preferably also extending over the nose and optionally also around the ears, presents a substantially unobstructed viewing aperture in front of the eyes of a wearer. At least one transverse element of the face guard extends across at least a part of the front of the face of a wearer and defines a lower laterally extending boundary of the viewing aperture. According to the invention, a transverse element which constitutes a lower laterally extending boundary of the viewing aperture functions as a sill which presents itself in the path of a projectile travelling in a direction through the viewing aperture.

The frame type face guard is comprised of a cage-like structure made from struts which may typically be made from wire or tough plastics material. Alternatives such as composite materials e.g. glass fibre or carbon fibre may also be contemplated. Suitable struts may typically have a circular cross section although other cross-sectional shapes may be envisaged.

The viewing aperture may preferably be substantially or completely unobstructed. Preferably, an unobstructed viewing aperture extends forward through said guard and laterally through an angle at a central vertical axis of said guard. Accordingly, the angle through which said viewing aperture extends is symmetrical about a central vertical axis of symmetry of the guard. In this specification the terms "viewing aperture" and "viewing gap" are synonymous. The viewing aperture may be generally defined between a lower front edge of a helmet and an upper edge of the sill of the face guard.

According to the invention, a transverse sill is positioned below the level of the eyes of a wearer during use. Accordingly, the first surface of the sill, which is adjacent the distal sill edge is at a height below the second surface which is adjacent the proximal sill edge. When viewed from the side, according to this embodiment, the distal edge is below the proximal edge and positioned more forward than the proximal edge in relation to the face of a wearer. In general, in this specification, the term "forward" or "distal" denotes a direction or relative position away in front of the guard—i.e. on the outside of the guard at its front, while the term "rearward" or "proximal" denotes a direction or relative position towards the origin of the guard, i.e. towards its centre. All directional and positional indications are relative to the guard during use, in a level position, as if on a wearer holding the head upright. Hence, a designation of an upward or downward direction refers to a corresponding respective direction along or parallel to a vertical centre line of the guard, when the guard is in its level position, as it would be on a wearer holding the head upright. The terms "lateral", or "transverse" refer to dimensions, directions or relative positions which are sideways outward from a central vertical plane of symmetry of the face guard.

In accordance with the invention, a transverse sill is a transversely oriented element which presents a proximal and a distal edge, wherein the respective proximal and distal edges are linearly spaced from one another approximately along a viewing axis of a wearer through the guard. Where a sill is comprised of two or more struts, the distal edge of the sill will be the most distal edge of all the respective sill struts, while the proximal edge of the sill will be the most proximal edge of all the respective sill struts.

In all cases, the proximal edge and distal edge lie approximately on a single common viewing axis. Accordingly, the first and second surfaces of the sill lie approximately along a viewing axis across the sill. In general, the said first and second sill surfaces are respectively comprised of a most distal and a most proximal surface of the sill at which there is a tangential intersection between the sill and a viewing axis through the sill. In further embodiments, there may be a third strut interposed between and in alignment with the distal and the proximal strut. Preferably, the respective transverse sill struts are separated by a gap which extends along all or part of the length of the sill struts.

According to the invention, a transverse sill comprises at least two adjacent struts which may be generally coextensive along all or part of the length of at least one strut. A first said strut presents a most distal first surface of the sill and a second strut presents a most proximal second surface of the sill. In accordance with the invention, the first and second surfaces of the sill both face in towards the viewing aperture and lie along a single common viewing axis. Further according to the invention, a gap extends transversely between adjacent struts of a sill. The said gap between two said substantially adjacent struts of said transverse sill is at least 4 mm across at its widest extent.

In some embodiments, one or more adjacent struts of a sill may extend in parallel or substantially in parallel to each other. In some embodiments, adjacent struts separated by a gap may extend parallel to each other—in other words, a gap between adjacent struts may be of a constant size across. In alternative embodiments, a gap between adjacent struts of a sill may vary along the transverse extent of the gap, i.e. along the length of the gap. In particular, the distance across the gap between adjacent sill struts may progressively decrease as the gap extends laterally towards the sides of the guard. In some preferred embodiments, the gap between adjacent struts has a maximum at a point around the horizontal apex of the sill, that is to say, the point on a sill which lies on a vertical central plane of symmetry through the guard. The distance across a gap between adjacent sill struts may decrease progressively towards the sides of the sill such that it reaches zero. Alternatively, the distance across a gap between adjacent sill struts may decrease progressively towards a minimum size, which may be non-zero.

In some embodiments the gap between adjacent struts may be about 4 mm or more at its widest extent. Preferably a gap may be at least 6 mm across at its widest extent. In other embodiments, this gap may be at least 8 mm across at its widest extent. In some embodiments, the gap may be no more than 25 mm across at its widest extent, preferably no more than 20 mm, and still preferably no more than 15 mm at its widest extent. In some embodiments, the gap may taper to a minimum towards the side regions of a sill. At its minimum extent, to the sides of the sill, a gap may for example be 1 mm or 2 mm across or in some cases it may be zero. For sill strut gaps having a large maximum extent such as, for example up to 20 mm, the minimum dimension of the gap, at the sides of the sill may be up to 10 mm or less. The term "parallel", when used in connection with adjacent struts of a sill may apply to sills having adjacent struts with a gap which varies only to a moderate extent, to that the struts have the appearance of being parallel. In some cases, the gap between adjacent struts may taper to an extent which makes the struts non-parallel but which may be nevertheless described or defined as "generally parallel", denoting that the departure from a parallel relationship between adjacent struts is modest.

In one embodiment, a transverse sill may comprise a strut defining a first surface at (or near) a first distal edge of the strut and another strut defining a second surface at (or near) second proximal edge of the strut, wherein the respective distal first and proximal second edges extend substantially parallel to each other and may be generally coextensive, at least along an arc which delimits at least a part of the viewing aperture. In particular, the first and second surfaces are linearly spaced apart along a single common viewing axis through the viewing aperture. According to this embodiment, the respective first and second surfaces, at or nearby the respective edges lie on one face of the sill. The term "coextensive" in this context, is intended to denote that struts in a sill extend along approximately a same length portion of the sill, which may be a whole sill length or part of a sill length. The term: "arc" is intended to denote the shape of a curved or generally curved portion of a guard, which may in particular be a sill, a sill strut of a viewing aperture.

In all embodiments of the face guard of the invention, the first and second surfaces of each sill are susceptible to be in the path of a projectile which is moving through the viewing aperture, otherwise known as the viewing gap. The presence of at least two surfaces at a sill in alignment along a common viewing axis ensures an increased amount of interference between a projectile and the face guard, thereby creating more friction and a greater level of dissipation of energy from the projectile to the guard than is the case where only a single surface is provided for contact between a projectile and a guard. Moreover, the alignment of the elements of the sill along the viewing axis ensures that there is increased interference of the sill with a projectile without increasing the visual profile of the guard frame from the point of view of a wearer, i.e. as seen by a sports player.

In a sill which extends below the eye level of a wearer, the common axis along which the first and second surfaces are disposed may typically intersect a central vertical axis of the face guard enclosing an angle between 60 and 35 degrees, more preferably between 55 and 40 degrees.

According to a further feature, the face guard has a sill having aforementioned first and second surfaces spaced along a viewing axis, which sill defines all or part of a side of a viewing aperture, and which sill extends laterally through an arc which describes an angle at a central vertical axis and symmetrically straddling a central vertical plane of the guard of at least 60 degrees, still more preferably at least 80 degrees. In some embodiments, it may be desirable to provide a sill around substantially the whole field of vision of a wearer, for example in an arc extending about at least 120 degrees, or at least 150 degrees. It may be desirable in particular to provide a sill which extends through an arc of between about 80 and 110 degrees. Optionally, a viewing aperture may be symmetrical about a central vertical plane of symmetry of the guard and may extend laterally through an angle of an approximate arc at a central vertical axis of at least 60 degrees, still more preferably at least 90 degrees, still more preferably at least 120 degrees, still more preferably at least 150 degrees. Considering that the lateral field of vision of humans lies around 160 degrees, it may be desirable to encompass as much of the natural field of vision as possible within the viewing aperture. Preferably, in a face guard according to the invention, the viewing aperture, or viewing gap, is configured such that a single sill as described, namely comprising respective first and second surfaces along a common viewing axis, is disposed across substantially the full lateral extent of the viewing aperture thereby constituting a lower sill positioned across substantially the full extent of the lower laterally extending boundary of the viewing aperture. In some embodiments according to the invention, the entire viewing aperture may be unobstructed.

In some embodiments the sill angle, i.e. the angle of the viewing axis along which the first and second sill surfaces lie, may vary around the sill. Typically, the sill angle may present a shallower aspect at the forward part of the sill than at its sides.

Still further according to the invention, the sill may comprise more than one strut of which one strut has a diameter at least 10 percent greater than the average diameter of the remaining struts of said face guard cage frame. Preferably, a strut having a larger than average diameter may be the most distal strut of said sill.

Preferably, the face guard of the invention may additionally be securely fixed to a peaked sports helmet. According to this embodiment, the face guard may be detachably fixed to said sports helmet by any suitable means including for example brackets or bolts. The face guard may in particular additionally comprise attachment means for securing the face guard about the face and head of a wearer. Suitable attachment means may for example comprise straps and a chin guard together with, if required padding elements located at various places inside the face guard. In particular, padding elements may be included on the face guard at chin elements and/or at any elements which rest on the wearer's forehead or at the sides of a wearer's face.

In another aspect, when the guard is attached to a helmet, the viewing aperture is defined between a lower front edge of the helmet and an upper edge of a lower sill of the face guard. Preferably, the viewing aperture thereby has a maximum width dimension in a vertical direction equal to between 65% and 95% of the diameter of a standard cricket ball or baseball. This combination of dimensions ensures that a ball will be blocked and may become trapped if it passes into the viewing aperture, without passing or prising its way through it. In some embodiments, the viewing aperture may be wider at its forward portion than at the sides of the guard. In particular, the widest part of the viewing aperture may be that part of the viewing aperture which extends between a lower sill and the peak of a helmet, while the viewing aperture may be narrower at the sides of the guard, laterally beyond the extent of the helmet peak. This ensures that the guard sill and helmet and peak are coextensive along the region in which viewing aperture is widest. Beyond the lateral sides of a helmet peak, where the sill and/or guard does not co-operate with a helmet peak, the viewing aperture may need to be narrower. Overall, the viewing aperture may occupy an area which may be described as the approximate shape of a segment of sphere.

In a further advantageous embodiment according to the invention, the guard may be secured to a helmet which has a composite peak with a generally rigid proximal peak portion attached to or integral with the helmet and a distal peak portion articulated thereon along a line of flexure. According to this embodiment, the distal peak portion is capable of being deflected upon impact with a projectile such as a cricket ball or baseball thereby presenting a blocking surface against the movement of the projectile. In particular, the distal peak portion is capable of being deflected in an upward direction after it has impacted with and been deflected by the sill of the face guard of the invention. Preferably, the face guard and helmet will tend to jam a ball which passes into the viewing gap.

Various features and advantages of the face guard of the invention will be better understood with reference to the accompanying figures which illustrate non-limiting examples.

Figure 1:
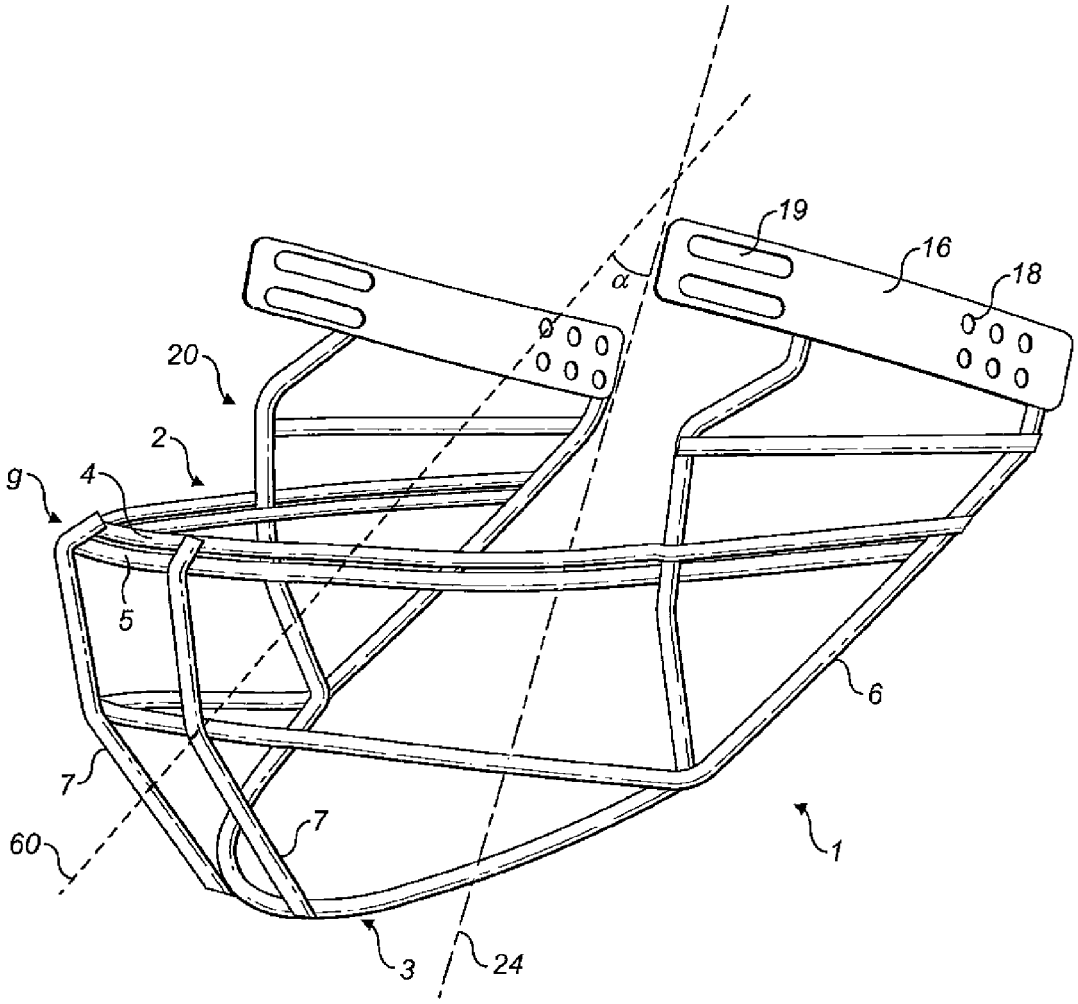
FIG. 1 shows a perspective view of a face guard according to aspects of the invention.

In FIG. 1, there is shown a cage type face guard 1 made from a frame of struts 2-7.

In this example, the struts 2-7 have a circular cross section although any suitable cross section may be selected. A rearward strut 6 extends at a region which lies beneath and behind the ear of a wearer during use. A lower strut 3 extends in front of and below the chin of a wearer during use. Two generally upright forward struts 7 link the lateral struts which surround the front of a wearer's face. The guard 1 further comprises an open region at its front portion which constitutes a viewing aperture (or viewing gap) 20. A wearer can look forward through the guard 1 though the viewing gap during use of the face guard. In the example of FIG. 1, the viewing gap 20 is completely unobstructed and extends about an arc of at least 180 degrees centred on a vertical axis of symmetry of the guard 1. A viewing axis 60 represents a line of sight of a wearer out through the viewing gap 20. The viewing axis line 60 which is shown passes tangentially across the inward facing surfaces of two adjacent struts 4, 5 of a sill 2. In particular, each of the proximal and a distal struts 4, 5 intersects tangentially with the viewing axis 60. The point of intersection between the respective struts 4, 5 and the viewing axis 60 is at a surface of each strut which faces inward, i.e. towards the viewing aperture 20. Also indicated in FIG. 1 is a vertical centre line 24 through the face guard 1 and about which the face guard extends generally circumferentially. As can be seen, the viewing axis line 60 intersects the centre line 24 making an included angle α. Attachment means for securely attaching the face guard to a helmet are illustrated in FIG. 1 by way of a bracket 16 comprising mounting holes 18 and slots 19 for receiving corresponding bolts fixed to a helmet shell. Alternative attachment elements may be provided.

In the guard of FIG. 1, the sill 2 extends across, beneath and adjacent the full lateral extent of the viewing aperture 20. The sill 2 defines the lower boundary of the viewing aperture 20. The two struts 4, 5 of the sill 2 are adjacent and coextensive and run substantially parallel to each other. The strut 4 is a most proximal strut, while the strut 5 is a most distal sill strut. In the example shown, the struts 4, 5 of the sill 2 extend beyond the lateral extent of the viewing aperture and at least partially cover a region which overlies the ears of a wearer. In alternative embodiments, the sill 2 may comprise more than two struts.

In the example of FIG. 1, there is a gap between the distal strut 5 and the proximal strut 4 of the sill 2. In this example, the width g across the gap is substantially constant around the entire extent of the adjacent sill struts 4, 5. In alternative embodiments, the width g across the gap may vary around the sill 2. In some embodiments, the width g across the gap may be at its greatest at the forward generally horizontal apex of the sill 2 and may gradually decrease towards the sides and rear of the sill 2.

A projectile such as a ball which approaches the face of a wearer 26 along a line through the viewing aperture will impact the sill 2 after which it may be deflected.

The friction between the ball and the sill 2 as well as the consequent energy dissipation and the ball's upward deflection contribute to provide a blocking effect on the ball, in particular, in combination with a helmet. In many cases, the ball will become jammed between the sill 2 and a helmet. In either case, the wearer 26 will be protected from the possibility of the ball prising open a viewing aperture between a lower front edge of a helmet and an upper edge of the sill 2 because of the greater friction and energy dissipation which the guard 1 provides.

Figure 2:
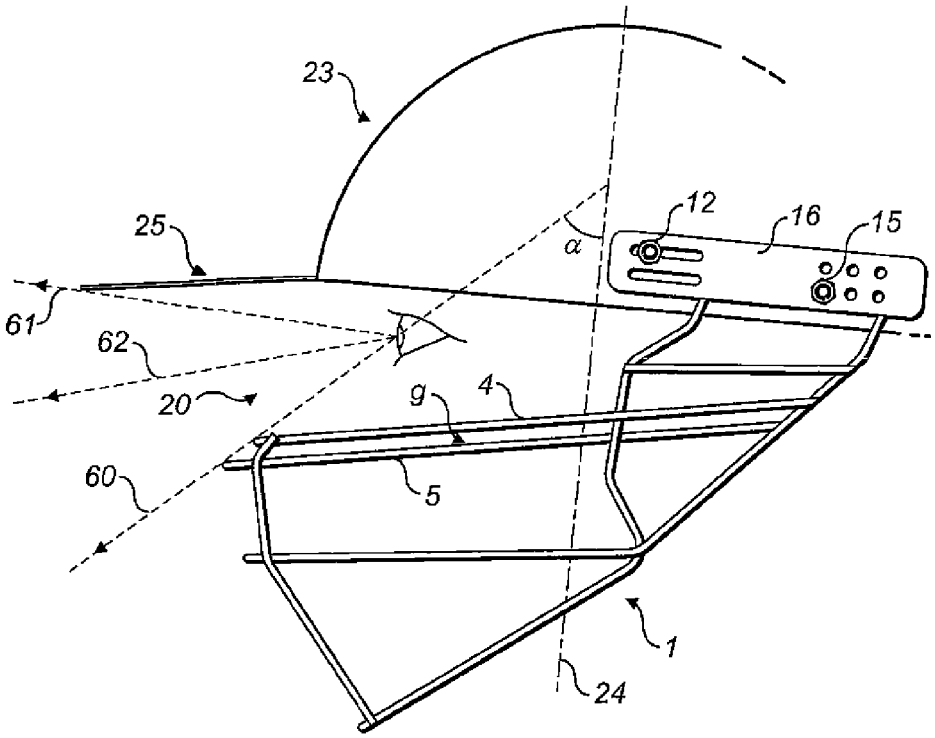
FIG. 2 shows a side view of a face guard combined with a peaked helmet.

The face guard 1 of FIG. 2 is attached to a helmet 23 comprising a domed main protective shell and a rigid peak 25. In FIG. 2, the peak 25 is shown integral with the helmet shell although it could be detachable from the shell. A sill 2 on the guard 1 comprises a first and a second strut 4, 5 which are arranged generally parallel. The sill 2 extends across the full lateral extent of the viewing aperture 20 although in some embodiments it may extend only partly across the lateral extent of the viewing aperture 20. The sill 2 constitutes the lower boundary of the viewing aperture 20 and has its widest extent at the front of the guard 1 and helmet 23. In the example of FIG. 2, the sill 2 rises progressively from a horizontal plane as it extends rearward towards the sides of the guard 1. The viewing gap 20 becomes progressively narrower around towards the sides and rear of the guard 1. A vertical centre line 24 runs through the combined guard 1 and helmet 23. The wearer's field of vision through the viewing aperture 20 is illustrated by the viewing axes 60, 62 or 61. Preferably, the substantially vertical distance across the viewing gap is slightly smaller than the projectile or ball in play. Most preferably, the substantially vertical distance across the viewing gap 20 corresponds to about 65% to 95% of the smallest diameter of a ball 48 or projectile in play. In particular, the substantially vertical distance across the viewing gap 20 at its most forward point, i.e. at the horizontal forward apex of the sill 2, corresponds to about 65% to 95% of the smallest diameter of a ball 48 or projectile in play. The most forward point of the sill 2 may coincide with the widest extent of the viewing aperture 20. The proximal and distal struts 4, 5 of the sill 2 are disposed approximately along a viewing axis 60. The more distal strut 5 is thereby masked or substantially masked by the more proximal strut 4. Any additional sill strut (not shown) may in particular be positioned between the distal strut 5 and the proximal strut 4, along the same line 60 as struts 4 and 5.

According to aspects of the invention, if a ball or other projectile travelling towards the viewing aperture 20, strikes the sill 2, it will tend to be slowed down by the action of the first and second surfaces of the sill 2 and it will tend to be deflected upwards towards the rigid peak 25 whereupon its passage will be blocked by the combined action of the sill 2 and the helmet peak 25.

Figure 3:
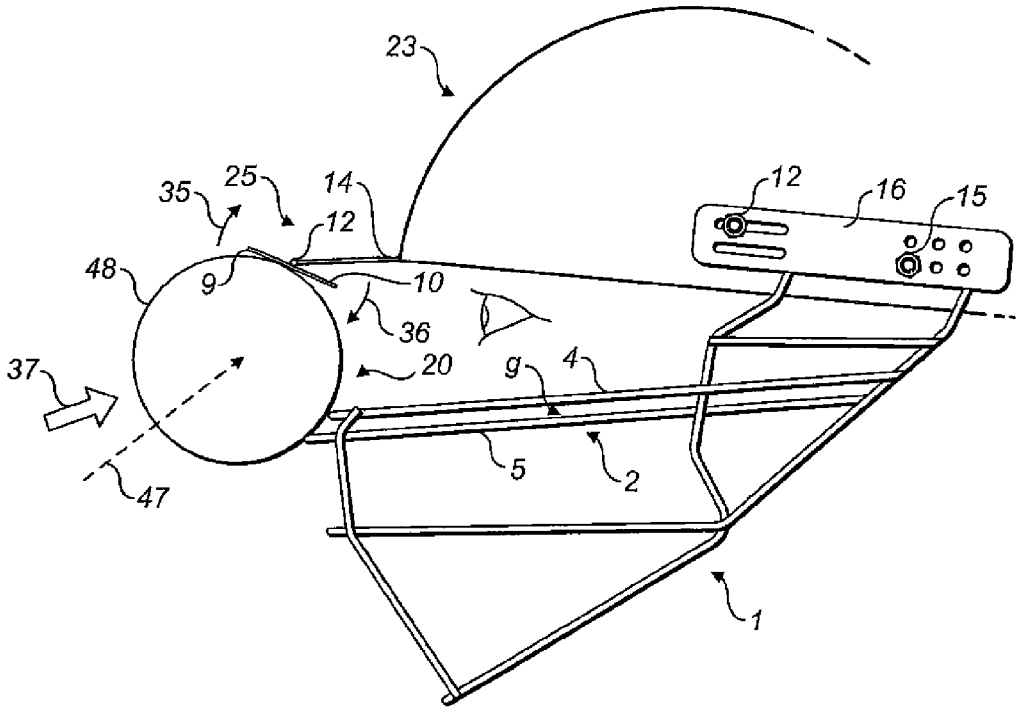
FIG. 3 shows a side view of an alternative embodiment of the guard and helmet combination of FIG. 2

In an improvement to the peak 25 of FIG. 3, there may alternatively be provided a composite peak comprised of a proximal rigid portion 14 and a movable distal portion 9, which is articulated on the proximal portion 14 along a line flexure 12. The line of flexure 12 may comprise a hinge element which may be any suitable hinge means such as a barrel and pivot hinge or a seam of flexible material along the longitudinal extent of the line of flexure 12. The composite peak 25 of FIG. 3 may, in conjunction with the guard 1, provide an enhanced blocking action against the progress of a projectile such as a ball 48 approaching along a direction 37 generally through or towards the viewing aperture 20. In particular a ball 48, having impacted the sill 2 and thereby losing some of its energy, will be urged upwards towards the composite peak 25, whereupon the distal portion 9 of the peak will pivot along the line of flexure 12. The pivoting effect of the distal peak portion 9 is to present a blocking surface obliquely to the direction of movement 47 of the ball 48. This tends to stop the ball 48 and also prevents the ball from prising open a gap between the helmet peak 25 and the sill 2 which could become large enough for it to pass through the viewing gap 20 to possibly injure a wearer. The pivoting away of the distal peak portion 9 prevents the ball 48 from obtaining any leverage on the peak 25. The blocking effect of the distal peak portion 9 may be enhanced by providing a rearwardly extending skirt 10 in association with the distal peak portion 9, configured such that the two parts of the movable distal peak portion 9 move together to present a blocking surface against the incoming ball 48. The combined effect of the composite peak 25 of FIG. 3 and the sill 2 may be to jam the ball 48 or at least to block its progress towards a wearer thereby preventing injury. In order to stabilise the distal peak portion 9 on the proximal peak portion 14, there may be provided a preventer device or biasing element tending to restrain any movement of the distal peak portion 9 under the action of forces below a predetermined level. In some cases it may be advantageous to provide the peak 25 detachable from a helmet shell, so that if a peak 25 is damaged by the impact of a projectile, it may be replaced by detaching it from the helmet shell and re-attaching a new one.

Figure 4:
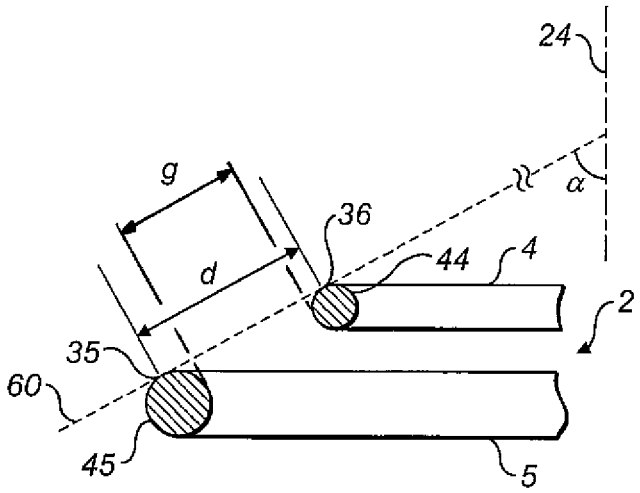
FIG. 4 is a cross section showing some details of sill geometry

In FIG. 4, there is shown some schematic detail of a sill configuration. In FIG. 4 the sill 2 is positioned below the eye level of a wearer during use, and is comprised of a proximal strut 4 and a distal strut 5. The distal strut 5 defines a most distal edge 45 of the sill 2 and presents a first surface 35 which faces towards a viewing gap (see FIGS. 1-3) of a guard 1 and which is exposed to contact with any projectile travelling along a trajectory generally through a viewing gap 20. Similarly, the proximal strut 4 defines a most proximal edge 44 of the sill 2 and presents a second surface 36 which faces towards a viewing gap 20 of a guard 1. Both the first and the second surface 35, 36 are linearly separated and lie along a common viewing axis 60. Each strut 4, 5 intersects at a tangent with a viewing axis 60 through a viewing aperture (see FIG. 2). The tangential point of intersection is at a first distal surface 35 and a second proximal surface 36, the first and second surfaces being spaced along the viewing axis 60. The separation along the viewing axis 60 between the first surface and the second surface may be called the "depth" of the sill and is shown with the letter "d". In most cases, the sill will have a depth of at least 6 mm or at least 7 mm or at least 8 mm. Ordinarily, the depth would not extent beyond the width of a projectile in play. Typically, the depth may extend up to about 35 mm or up to about 25 mm or up to about 20 mm. A guard depth between 10 mm and 20 mm may be most preferred. In FIG. 4, the viewing axis 60 is shown intersecting the vertical centre line 24 at an angle α, which preferably lies in the range between 30 and 70 degrees, preferably between 35 and 60 degrees, still more preferably between 40 and 55 degrees. A projectile or ball striking the sill 2 will be impeded first by its contact with the first surface 35 and then by a further contact with the second surface 36. It will be deflected towards a helmet peak with less energy than it originally possessed, and will therefore be more readily stopped. A projectile such as a ball which strikes the sill 2 in FIG. 4 will first give up some energy to each of the two struts 4, 5 before being urged towards a helmet such that there is an enhanced tendency for the projectile to be blocked by virtue of the increased friction effect and by virtue of the projectile being deflected. As can be seen, the strut 5 has a larger diameter than the strut 4 and is thus capable of absorbing and dissipating a greater amount of energy from a projectile. In embodiments comprising more than two sill struts, two adjacent struts may be touching while a separation between at least one strut and an adjacent strut is provided. In embodiments according to the invention, there is a gap having a width between at least two adjacent struts.

Also shown in FIG. 4 is a width g across a gap separating adjacent struts 4, 5 of a sill 2. A gap may be provided between any pairs of adjacent struts of a sill 2. The width g across a gap between adjacent struts may be substantially constant or it may vary. In particular, in certain embodiments, a gap may have a maximum width g at a point along a sill 2 on a vertical plane of symmetry of a face guard 1 which may be defined as a horizontal forward apex of a sill 2. A gap width g between adjacent struts may progressively decrease with distance away from the apex and may optionally reach zero.

The invention and various embodiments thereof has been described with reference to non-limiting examples. Additional features of the invention will be apparent to one of ordinary skill in the art within the scope of the appended claims.

What is claimed:

1. A face guard configured for use in connection with a helmet comprising:

attachment means for securely attaching said face guard to the helmet; and a construction surrounding and protecting at least the front and sides of the jaw of a wearer such that said face guard creates an unobstructed view through a viewing aperture proximate to the eyes of a wearer during use, wherein said construction comprises a transverse sill defining a boundary of said viewing aperture, said transverse sill is positioned below the level of the eyes of the wearer during use, said transverse sill comprises at least a first strut and a second strut, which are substantially adjacent each other and generally transverse, and extending across the front of the face of the wearer during use, said first strut defines a first surface which is a most distal surface of said transverse sill, and said second strut defines a second surface which is a most proximal surface of said transverse sill, said first strut and second strut are disposed such that a straight line tangent to the first and the second surfaces pierces through the viewing aperture and said straight line intersects with the helmet at a position rearward of a vertical center line, about which the face guard extends generally circumferentially, said transverse sill further comprises a proximal edge and a distal edge, wherein the first surface of said transverse sill at said distal edge and the second surface of said transverse sill at said proximal edge are spaced linearly apart and lie approximately along a common viewing axis of the wearer during use, the first strut and the second strut are separated by a gap at least 4 mm across at its widest extent, and said first surface at said distal edge is at a height below said second surface at said proximal edge.

2. The face guard according to claim 1, wherein said gap extends through so as to cover at least 30 degrees of lateral field of vision of the wearer.

3. The face guard according to claim 1, wherein said gap between the first strut and the second strut is at least 4 mm across at its widest point, and wherein said gap progressively decreases towards lateral sides of said face guard.

4. A face guard according to claim 1, said face guard defining a central vertical axis through said face guard, wherein said common viewing axis along which said first and second surfaces are disposed intersects said central vertical axis enclosing an internal angle between 60 degrees and 35 degrees.

5. A face guard according to claim 1, wherein parts of said transverse sill which present said first and second surface on a common viewing axis, extend through the viewing aperture so as to cover at least 60 degrees of lateral field of vision of the wearer.

6. A face guard according to claim 1, said face guard being securely fixed to a peaked sports helmet, wherein said viewing aperture is defined between a lower front edge of said helmet and an upper edge of said transverse sill of said face guard.

7. . A face guard according to claim 6, said viewing aperture having a maximum width dimension equal to between 65% and 95% of the diameter of a cricket ball or baseball.

8. A face guard according to claim 6, said helmet having a composite peak with a rigid proximal peak portion and a distal peak portion articulated thereon along a line of flexure, said distal peak portion being capable of being deflected upon impact with a projectile such as a cricket ball or baseball thereby presenting a blocking surface against the movement of said projectile.

9. A face guard according to claim 6, wherein said viewing aperture is configured, for a cricket ball or baseball passing into said viewing aperture between said guard and said helmet, to be blocked and to be jammed.

10. A face guard according to claim 1, wherein said gap between the first strut and the second strut is at least 6 mm across at its widest point or at least 8 mm across at its widest point.

* * * * *